US005852845A

United States Patent [19]

Michelson

[11] Patent Number: 5,852,845

[45] Date of Patent: Dec. 29, 1998

[54] DEVICE FOR EXTRACTING WATER FROM PHOTOGRAPHIC FILM

[76] Inventor: Manfred G. Michelson, 4396 Park Vicente, Calabasas, Calif. 91302

[21] Appl. No.: 739,513

[22] Filed: Oct. 28, 1996

Related U.S. Application Data

[63] Continuation-in-part of Ser. No. 362,208, Dec. 22, 1994, Pat. No. 5,568,822, which is a continuation-in-part of Ser. No. 103,285, Sep. 10, 1993, abandoned.

[51] Int. Cl.[6] ..... B08B 5/00

[52] U.S. Cl. ..... 15/309.1; 15/302; 15/345

[58] Field of Search ..... 134/64 P, 122 P, 134/182, 102.1, 102.3, 64 R, 186, 183, 199, 306.1, 309.1; 15/306.1, 309.1, 308, 345; 239/103, 120, 533.13, 437, 452; 118/50; 430/935

[56] References Cited

U.S. PATENT DOCUMENTS

| | | | |
|---|---|---|---|
| 263,634 | 8/1882 | Webster . | |
| 577,362 | 2/1897 | Ettlinger | 239/533.13 |
| 1,793,246 | 2/1931 | Philips . | |
| 2,181,487 | 8/1939 | Khuen-Kryk | 15/345 |
| 2,255,951 | 9/1941 | Tomtlund . | |
| 2,303,992 | 12/1942 | Frazer | 239/533.13 |
| 2,311,833 | 2/1943 | Holland-Letz | 239/533.13 |
| 3,162,559 | 12/1964 | Thompson et al. . | |
| 3,199,787 | 8/1965 | Oishei et al. | 239/533.13 |
| 3,370,982 | 2/1968 | Hayunga . | |
| 3,587,128 | 6/1971 | Massapequa et al. | 15/308 |
| 3,688,527 | 9/1972 | Blustain . | |
| 3,766,756 | 10/1973 | Farrar | 68/19.1 |
| 4,315,344 | 2/1982 | Woodward et al. | 15/345 |
| 4,447,924 | 5/1984 | Bolton et al. | 68/19.1 |
| 4,477,287 | 10/1984 | Kush et al. | 15/345 |
| 4,842,000 | 6/1989 | Malashenko . | |
| 5,519,945 | 5/1996 | Ahvenniemi et al. | 15/345 |

FOREIGN PATENT DOCUMENTS

| | | | |
|---|---|---|---|
| 1233428 | 10/1960 | France | 34/639 |
| 2440228 | 5/1980 | France . | |
| 465474 | 4/1927 | Germany . | |
| 668741 | 3/1952 | United Kingdom | 34/639 |
| 895655 | 5/1962 | United Kingdom | 34/639 |
| 909423 | 10/1962 | United Kingdom . | |
| 931653 | 7/1963 | United Kingdom . | |

*Primary Examiner*—Jill Warden
*Assistant Examiner*—Paul J. Lee
*Attorney, Agent, or Firm*—Merchant, Gould, Smith, Edell, Welter & Schmidt

[57] ABSTRACT

A manifold unit for extracting water from a photographic film strip. The manifold unit comprises a base wall lying along a plane transversely intercepting the broad face of the curved film strip, a number of elongated members extending from the base wall towards the broad face of the film strip and spaced apart to define air conduits therebetween, the elongated members having terminal surfaces adjacent to the film strip and forming an acute angle with the film strip path such that the trailing edge of the terminal surface is closest to the film strip, air pressure conduit in communication with some of the air conduits and air suction conduit in communication with other of the air conduits.

5 Claims, 4 Drawing Sheets

DEVICE FOR EXTRACTING WATER FROM PHOTOGRAPHIC FILM

RELATED APPLICATIONS

This application is a continuation-in-part of application Ser. No. 08/362,208, filed Dec. 22, 1994, and now U.S. Pat. No. 5,568,822, which was a continuation-in-part of application Ser. No. 08/103,285, filed Sep. 10, 1993, now abandoned, each of which is incorporated herein by reference.

BACKGROUND OF THE INVENTION

This invention relates to apparatus and processes for cleaning photographic film, and more particularly to liquid cleaning systems for long lengths of photographic film, which systems neither significantly affect the image areas of the film, as by abrasion, nor cause significant detrimental liquid interaction with the film.

In the movie film and photographic industries various techniques have been devised over the years for cleaning film surfaces to eliminate dust, particulates and other materials which wear, abrade, or obstruct portions of the photographic image areas. Cleaning is regularly used before printing, but the methods typically used for cleaning have often affected the film itself. In particular it is common for film to become damaged during processing and this damage is often in the form of tears or other distortions in the edges of the film. These discontinuities present a problem in the operation of a high speed cleaning apparatus as they can catch in the components of the apparatus. This results in an extension of the tear, introducing a complete break in the film as it is being washed or brushed clean. The broken film then, moving at high speed, jams the machinery, and accumulates in a disordered mass, causing time to be lost while the film is removed and substantial financial loss due to film damage from the tear and water contact.

For such reasons, high speed apparatus is needed which substantially eliminates film breakage due to engagement of film discontinuities during high speed movement through a cleaning system. Water applied during cleaning steps is substantially removed by an extraction system close to the film path, but the close proximity must be maintained without engagement that can break the film.

SUMMARY OF THE INVENTION

The present invention is directed at a manifold unit for extracting water from a photographic film strip by alternate direction airflows. The manifold unit comprises a base lying along a plane transversely intercepting the broad face of a curved film strip. A number of elongated members extend from the base towards the broad face of the film strip and are spaced apart to define air conduits therebetween, the elongated members having terminal surfaces adjacent to the film strip. The terminal surfaces of the members lie along different acute angles with respect to the curved film strip path such that the trailing edge of each terminal surface is closest to the film strip. Also, the angles of the conduit walls are differently slanted with respect to the film path. This conformation allows tears and other discontinuities in the film to slide over the surface of the terminal surfaces without catching on the elongated members. Nonetheless, the open ends of the conduits are close enough to the film to provide progressively greater extraction of adsorbed water by the alternating air flows.

The unit further includes air pressure means in communication with some of the air pressure conduits and air suction means in communication with others of the air conduits, the pressure and suction conduits alternating along the path of film movement.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
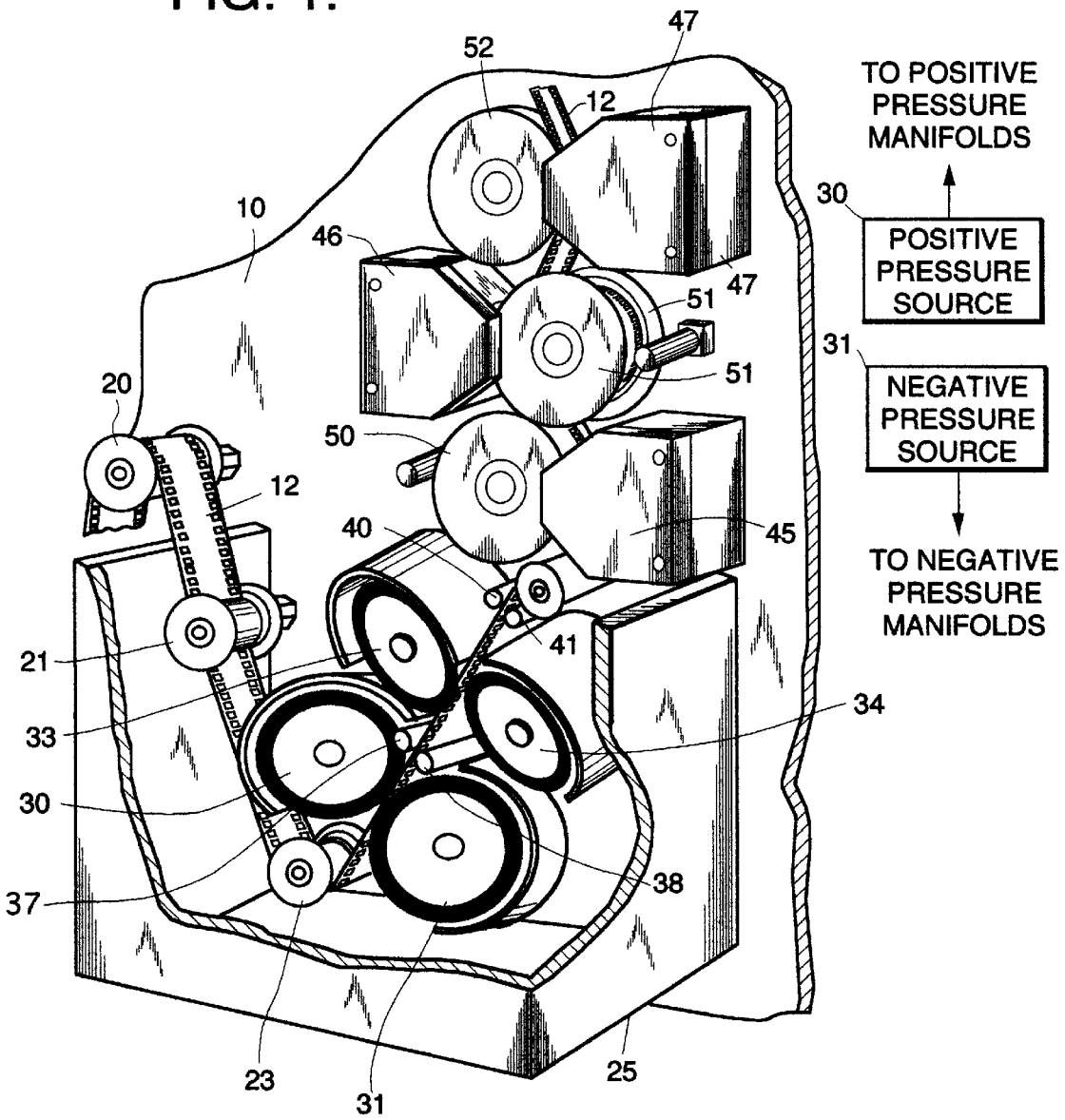
FIG. 1 is a perspective view of a portion of the front panel of a film cleaning system in which the present invention is suitable for use.

An example of a film cleaning system suitable for use with the present invention is shown in part in FIG. 1 and described in detail in U.S. patent application Ser. No. 08/362,208, to which reference may be made for further explanation. The system comprises a console having a front panel 10, and is separated into two halves through which the film 12 is successively threaded. A cleaner and dryer subsystem 14 is shown as it is disposed in the left half, and a dry box (not shown) is in the right half of the console. In this configuration, a supply hub supports a supply reel (not shown) of film 12 in the lower part of the cleaner and dryer subsystem 14. The film 12 is fed along a multi-curved path through the cleaner subsystem into the dry box, from which the film 12 is passed out to a take-up reel(not shown) for collection. The system operates to drive the film 12 at substantially constant velocity between the reels, and any of the different conventional systems for this purpose may be used. Similarly, specific braking, tensioning, velocity sensing and like features that may be used need not be shown or described.

From the supply reel, as seen in FIG. 1, the film 12 is guided through a pair of guide rollers 20, 21 and turned around a bottom guide roller 23 within a water confinement box 25 within which the film cleaning is effected. Although high velocity sheet jets may be employed, as shown and described in aforementioned application Ser. No. 08/362,208, the invention is depicted in relation to a water and brush cleaning example also described in that application.

Behind the front panel 10, as viewed in FIG. 1, the console includes subsystems for controlling mechanical devices, providing the needed differential pressures, and supplying the water flows that are required in the system. Here only a positive pressure source 28 and a negative pressure or suction source 29 are relevant to the water extraction device so that they alone are shown or referred to in the Figures. The film 12 is cleaned in the water confinement box 25 by first and second pairs 30, 31 and 33, 34 of rotating brushes successively downstream along the film path. Each pair spans the film 12 at an angle, of opposite sense between the pairs, to the film length and rotates so that its peripheral brushing movement is opposite to that of the film 12, and also directs particles and dirt on the film beyond the film edges. The brushes 30, 31 and 33, 34 and film 12 are lubricated in the contact regions by downwardly directed water jets 37, 38 and 40, 41 which reduce friction and aid in transport of the particulates away from the film 12. Distilled water is pumped from a supply or water collection tank (not shown) through a submicron filter (not shown) to the water jets 37, 38 and 40, 41, outflow being fed back into the system from the box 25 in a recirculating fashion. Further details and advantages can be derived by reference to the parent application referred to above. The water adsorbed on the film 12 in these steps, however, will be absorbed in the film substrate and photosensitive layers with detrimental effect unless very quickly removed.

For this reason, the film 12 leaving the water confinement box 25 passes serially through three (in this example) water extraction stations 45, 46, 47, each in close proximity but on the opposite side of the film 12 from individual turnaround rollers 50, 51, 52 respectively.

The vacuum or negative pressure air source 29 and the positive pressure source 28 supply needed functions in the water cleaner subsystem 14, which includes alternating conduits for the opposite flows, as described below.

Figure 2:
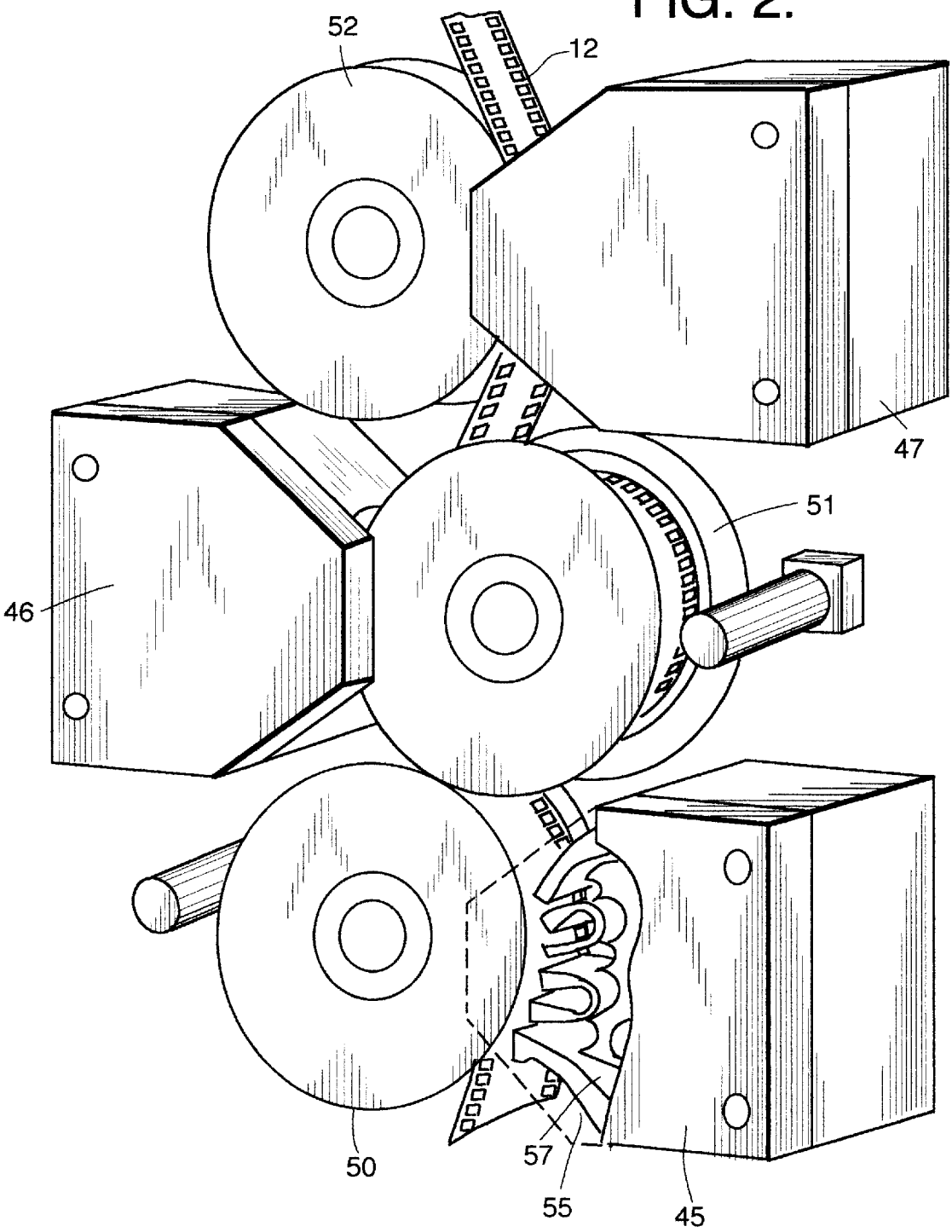
FIG. 2 is an enlarged perspective view, partially broken away, of a portion of the mechanism on the front panel of FIG. 1, showing how the principal elements of water extraction devices are arranged in the system.
Figure 3:
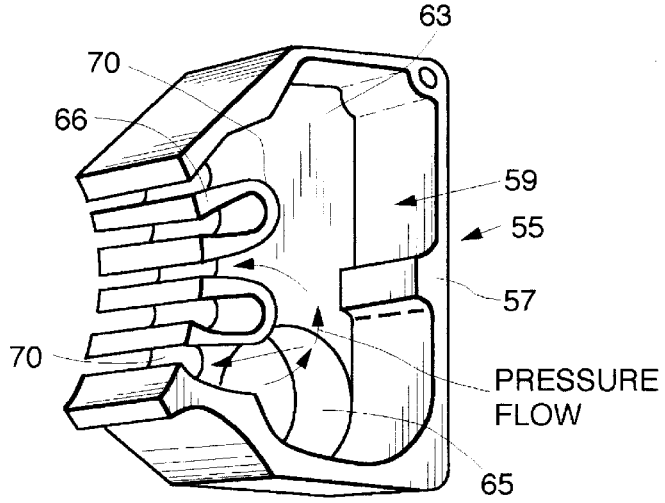
FIG. 3 is a perspective view of a water extraction device of FIGS. 1 and 2, with side walls removed.

As seen in FIGS. 1 and 2, the roller 50 for a first wraparound arc provides counter-clockwise passage of the film 12 about the center of the roller. The roller 50, as well as all other rollers in the system, has raised side ridges and a space between the center of the roller and the image portion of the film.

Figure 4:
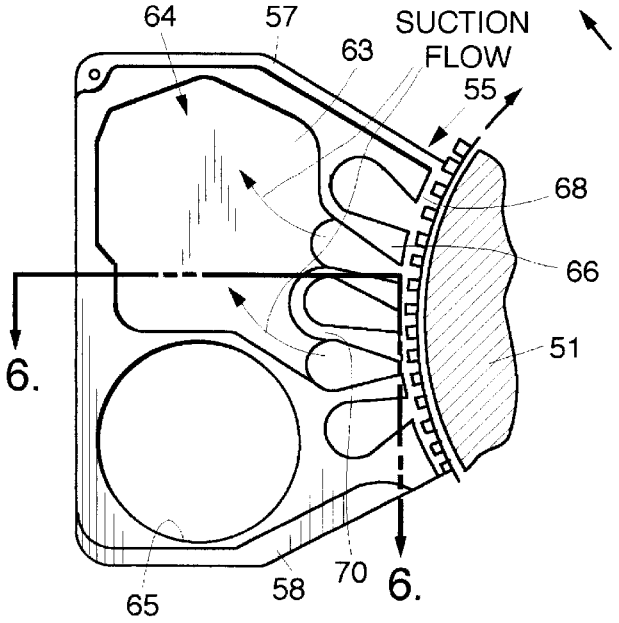
FIG. 4 is a side view of the water extraction device of FIGS. 2 and 3, in relation to a film and roller.
Figure 6:
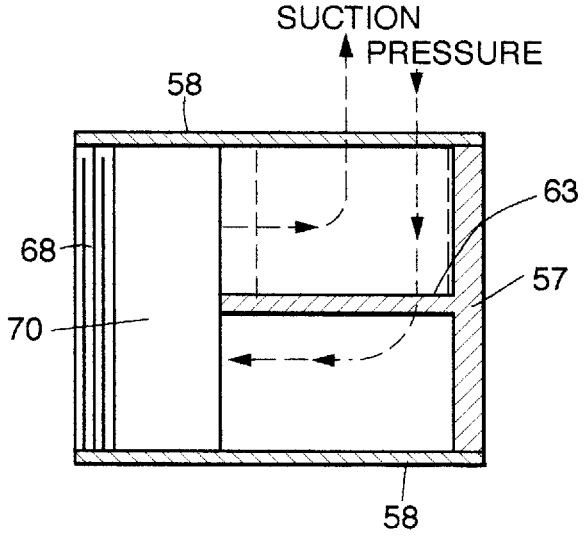
FIG. 6 is a rear sectional view of the arrangement of FIGS. 3–5, taken along the line 6—6 in FIG. 4, and looking in the direction of the appended arrows.

The water extraction devices 45, 46, 47 each include a water removal manifold 55 disposed along the path of the film 12. As seen in FIG. 4, the center water removal manifold 55, in this example, is coextensive with a substantial length of the wrap-around arc at the second roller 51. The same relationships are used at the first and third roller 50, 52 and water extraction devices 45 and 47, in a mirror image structure of like function, so only one water removal manifold 55 will be described specifically. Reference is now made to the detailed views of FIGS. 3 to 6.

The manifold 55 is advantageously formed in this instance as part of single block 57, of cast or molded form, and here of aluminum. A positive pressure inlet from the source 28 (FIG. 1) leads into a positive pressure manifold 59 in the block 57 (see FIGS. 4 and 5 also), whose side walls 58 are shown only in FIGS. 4 and 6. A separator wall 63 in the block 57 separates the internal positive pressure manifold 59 from a negative pressure manifold 64 along a plane substantially bisecting the film 12 length (see FIG. 6). The separator wall 63 includes a lateral bore 65 that provides a flow path from the positive pressure source 28 to the positive pressure manifold and then the conduits.

Short segment radial conduits in the block 57 terminating in air nozzles adjacent the film 12 are spaced apart along the water removal arc of the water extraction manifold 55. These conduits and end nozzles are formed by spaced apart wall segments 66 somewhat radially disposed relative to the opposed roller 51 and include end shoes 68 whose end surfaces are also selectively angled. The conduits and nozzles create small lateral band-like jets of flow onto or away from the film 12 surface. The wall segments 66 forming the alternating flow conduits are defined by approximately U-shaped members 70 shaped as part of the block 57. They thus define negative pressure conduits 72 closely alternating with positive pressure conduits 74, these conduits being in communication with the negative and positive pressure sources 29, 28 (FIG. 1) via the positive and negative pressure manifolds 59, 64 respectively. Conduits and ports for the positive and negative pressure systems can be conventional and are not shown in detail for clarity. The terms "positive" and "negative" in this context refer to local pressures relative to the ambient pressure in the system.

Figure 5:
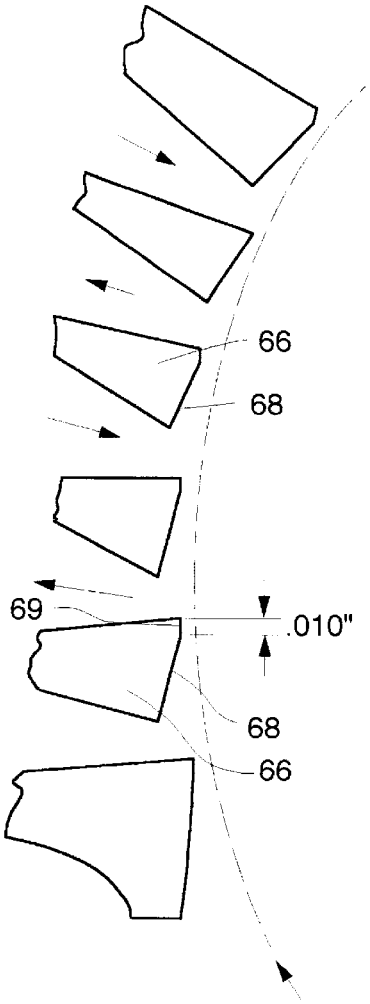
FIG. 5 is an enlarged fragmentary view of conduit-defining walls of the water extraction mechanism of FIG. 4.

The end shoes 68 are angled relative to radii from the roller 51 such that the leading edges, those edges first passed by the film 12, are below the trailing edges. The trailing edges of the shoes 68 also include a small flat 69 of about 0.010" (0.25 mm) as best seen in FIG. 5. The angling of the end shoes 68 thus helps to insure that a protruding torn edge of the film does not encounter a corner surface. Because of the local stiffness of the film and the ease with which a tear will propagate, any catching against a fixed surface almost ensures complete fracture and consequent film damage. Instead, if there is a tear or other discontinuity, it first encounters the slanted side of an end shoe 68 at a low angle, and when it passes to the next end shoe 68, it misses the leading edge and slides along the face of that end shoe, thus avoiding being caught and torn on the side wall edge. In addition, the side walls 58 are slightly angled (see FIG. 4) in the upstream direction relative to the film movement to increase the acute angle between the end shoe 68 face and the film 12. These features of the present invention ensure that the washing of the film can be conducted at high speed, without the need to stop the washing process to remove broken film.

Although a number of forms and modifications in accordance with the invention have been described, the invention is not limited thereto but includes all variations and alternative expedients within the scope of the appended claim.

In the claims:

1. A manifold unit for extracting water from a photographic film strip having a broad face moving along in a curved path, the unit comprising:

a base member lying along a path adjacent the broad face of the curved film strip;

a number of elongated members extending from the base member towards the broad face of the film strip and spaced apart to define air conduits therebetween, the elongated members having terminal surfaces adjacent to the film strip, each forming an acute angle with the film strip path such that each trailing edge of the terminal surface is closest to the film strip;

air pressure means in communication with some of the air conduits; and air suction means in communication with other of the air conduits;

and the base member includes a separator wall substantially along a plane bisecting the length of the film strip, wherein said air pressure means being on one side of the separator wall and said air suction means being on the other side of said separator wall.

2. A manifold unit as set forth in claim 1, wherein the trailing edges of the terminal surfaces are beveled.

3. A manifold unit as set forth in claim 1, wherein the air pressure and air suction means are in communication with alternate ones of the conduits, and wherein the elongated members are directed toward the curved film path at angles to increase the acute angles of the terminal surfaces, and wherein the air pressure means includes a manifold on one side of the separator wall and the air suction means includes a manifold on the opposite side of the separator wall.

4. A device for extracting water from the surface of a film that has been wetted down during cleaning comprising the combination of:

roller means for moving the film along a curved path to provide a convex arc segment; and a water extraction manifold disposed on the opposite side of the film from the roller means at the convex arc segment, the water extraction manifold including a number of wall segments approximately radially disposed relative to the convex arc segment and terminating in end surfaces adjacent to but not contacting the film, the wall segments having end surfaces angled at acute angles relative to the opposed film such that the leading edges are spaced apart from the film at a greater distance than the trailing edges, the wall segments each spanning a substantial difference of the film between its edges, the manifold further including a body portion having an internal separator wall coupled to the wall segments on the side opposite the film, and configured to define pressure and suction manifolds on opposite sides of the wall, the body and wall segments further being configured to define alternating pressure and suction conduits in communication with the film, and the body including side walls completing the manifolds.

5. A device as set forth in claim 4 above, wherein the wall segments are configured as U-shaped elements of limited length relative to the manifold, and the wall segments are angled relative to the true radii of the arc segment to increase the acute angle of the end surface relative to the film and wherein the trailing edges of the end surfaces have a small flat relative to the end surface dimension in the direction of film travel.

* * * * *